US010744559B2

(12) United States Patent
Comand et al.

(10) Patent No.: US 10,744,559 B2
(45) Date of Patent: Aug. 18, 2020

(54) DEVICE FOR THE SOFT REDUCTION OF ROUND-SECTION METAL PRODUCTS

(71) Applicant: Danieli & C. Officine Meccaniche S.P.A., Buttrio (IT)

(72) Inventors: Daniele Comand, S. Maria di Lestizza (IT); Antonio Sgro', Reana del Rojale (IT); Luca Cestari, Moruzzo (IT); Alfredo Poloni, Fogliano Redipuglia (IT); Marcellino Fornasier, Spilimbergo (IT)

(73) Assignee: DANIEL & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 16/338,564

(22) PCT Filed: Oct. 12, 2017

(86) PCT No.: PCT/IB2017/056300
§ 371 (c)(1),
(2) Date: Apr. 1, 2019

(87) PCT Pub. No.: WO2018/069854
PCT Pub. Date: Apr. 19, 2018

(65) Prior Publication Data

US 2020/0038945 A1 Feb. 6, 2020

(30) Foreign Application Priority Data

Oct. 12, 2016 (IT) ..... 102016000102472

(51) Int. Cl.
*B22D 11/12* (2006.01)
*B22D 11/128* (2006.01)
(Continued)

(52) U.S. Cl.
CPC ..... *B22D 11/1206* (2013.01); *B21B 1/46* (2013.01); *B22D 11/041* (2013.01); *B22D 11/12* (2013.01);
(Continued)

(58) Field of Classification Search
CPC ... B22D 11/12; B22D 11/1206; B22D 11/128; B22D 11/1282; B21B 1/46; B21B 13/12
See application file for complete search history.

(56) References Cited

U.S. PATENT DOCUMENTS 4,294,306 A * 10/1981 Berenov ..... B22D 11/1284 144/208.8
4,619,310 A * 10/1986 Andoh ..... B22D 11/1282 164/442
5,497,821 A * 3/1996 Arvedi ..... B22D 11/1206 164/476

FOREIGN PATENT DOCUMENTS

DE 19722980 6/1998
DE 102010034399 2/2012
(Continued)

*Primary Examiner* — Kevin E Yoon
(74) *Attorney, Agent, or Firm* — Stetina Brunda Garred and Brucker

(57) ABSTRACT

A soft reduction device (1) of a round-section metal product, having liquid or partially liquid core, for reducing the thickness of said metal product coming from a continuous casting machine, the device comprising at least two soft reduction units (2, 3); in which said at least two soft reduction units (2, 3) are arranged in series; in which each soft reduction unit (2, 3) is provided with a group of only three rolls arranged at 120° from one another; and wherein the group of three rolls (7, 8, 9) of one soft reduction unit is offset by a predetermined angle with respect to the group of three rolls (10, 11, 12) of an adjacent soft reduction unit.

17 Claims, 6 Drawing Sheets

(51) Int. Cl.
*B21B 1/46* (2006.01)
*B22D 11/041* (2006.01)

(52) U.S. Cl.
CPC ..... *B22D 11/128* (2013.01); *B22D 11/1282* (2013.01)

(56) References Cited

FOREIGN PATENT DOCUMENTS

| | | | | | |
|---|---|---|---|---|---|
| EP | 1291099 | | | 3/2003 | |
| EP | 3012043 | | | 4/2016 | |
| GB | 1175818 | | | 12/1969 | |
| JP | 01289552 | A | * | 11/1989 | ..... B22D 11/1206 |
| JP | H09300053 | | | 11/1997 | |

* cited by examiner

DEVICE FOR THE SOFT REDUCTION OF ROUND-SECTION METAL PRODUCTS

CROSS REFERENCE TO RELATED APPLICATION(S)

The present application claims priority to PCT International Application No. PCT/IB2017/056300 filed on Oct. 12, 2017, which application claims priority to Italian Patent Application Nos. 102016000102472 filed Oct. 12, 2016, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a soft reduction device for round-section blumes or billets having liquid or partially liquid core, coming from a continuous casting machine, in order to compress the product in a controlled manner, thus reducing the liquid section and improving the inner quality thereof.

BACKGROUND ART

Various devices and methods for pressing a liquid-core cast product are known from the prior art, and this operation is called "soft reduction".

This technology is particularly common within the area of slabs, which are characterized by being much wider than they are thick.

The skin of the product begins forming in the crystallizer due to the progressive cooling to which the product is subjected. As the product travels downstream dragged by the straightening units, it is subjected to continuous direct and indirect cooling operations and this results in an increase of the thickness of the skin, resulting from the subtraction of heat from the core of the product performed by the cooling system.

The product is cast from the tundish into the crystallizer and starts its descent towards the extraction area downstream, being cooled and contained by the containment rolls. The thickness of the product skin increases as the product descends and cools off, until there is the spontaneous joining of the skin in the so-called "metallurgical cone", at which point the complete solidification of the product is achieved.

The process for forming the skin generally is influenced by various parameters, in particular by the steel grade of the cast product, by the heat exchange undergone by the cast product during casting, by the casting speed and by the dimensions of the product itself.

It is necessary that the complete solidification of the product occurs so as to preserve the inner quality thereof: indeed, as the product solidifies, there is a decrease of the volume occupied by the liquid fraction which initially occupies a larger volume with respect to the solid fraction. This volumetric difference does not affect the product very much in the first part of the casting curve, since the liquid fraction volume lost during solidification is replaced by the liquid further upstream pushed downstream by the ferrostatic pressure. However, in proximity of the vertex of the metallurgical cone, the solid component and the liquid component are no longer well distinguished from each other, thus causing the so-called "mushy zone".

From a microscopic point of view, the appearance of the skin of the product in contact with the liquid core has a series of crystalline branches called dendrites, which when the skin is about to be joined, tend to intersect with one another, thus forming a barrier for the inlet of the liquid above, preventing filling with new liquid in the areas subjected to a decrease of the volume of liquid fraction due to the solidification, and causing the formation of undesired porosity in the inner structure of the product.

A further problem generated in this solidification step is that of macro segregations: as the product solidifies, the dendrites extend and tend to bring the alloy elements (e.g. carbon, sulfur, etc.) towards the liquid core of the product. This phenomenon causes a difference in the chemical composition along the section of the product. These migrations of alloy elements cause undesired differences of the mechanical properties, thermal properties, etc. between the various areas of the product, while a product having uniform structure and properties is instead desirable.

In order to obviate these drawbacks, the soft reduction treatment was developed, which provides the controlled pressing of the cast metal products, e.g. slabs or blumes or billets, wherein the cast metal product is subjected to an action of reducing the thickness while the core is still liquid or partially liquid in an area downstream of the ingot-mold, thus obtaining a less thick product with respect to the cast one at the outlet of the continuous casting machine.

The main advantage of reducing the thickness of the liquid or partially liquid core is to obtain an improvement of the solidification structure together with an improved inner quality of the cast product.

In order to be effective, the soft reduction should occur with a continuous and controlled reduction of the thickness of the cast product up to when it contains therein a liquid or partially liquid core, which may be obtained with a substantially conical reduction profile of the stretch of cast product involved.

The most common soft reduction devices provide pressing the product by means of pairs of opposite rolls: the pressing force here is therefore applied with equal intensity and opposite direction, thus causing a decrease of the thickness of the product and an extension thereof (called "bulging").

This soft reduction treatment is commonly used in the field of continuous slab casting since the widening of the side faces is not such as to seriously affect the finished product which, once the curved sides have been conveniently trimmed, will be ready for rolling or other successive operations.

With regards instead to products having rectangular or square section, the soft reduction is to be performed more carefully, since an excessive curving would cause an excessive deformation of the products which would then be difficult to process.

This problem is felt even more for round-section products since keeping the shape is essential for processing and selling the product on the market: indeed, by using only two rolls which press the product in opposite directions to close the liquid core thereof, there is a risk of excessive oval deformation of the section of the product. In an attempt to correct this ovalization, another deformation may be generated, made with rolls shaped so as to obtain a round section with a smaller section. However, this further deformation, which requires at least two passes, does not always decrease the section of the product and at the same time keep it perfectly round. Indeed, further forming passes are often required downstream for the further definition of the round geometry.

A partial solution to this problem provides eliminating the first pressing step by directly casting an elliptical-section product which in the next soft reduction step is deformed into a round shape by two parallel shaped rolls.

However, the deformation operation to pass from the elliptical section to the round section—in particular, the more the ellipse is pressed—results in tensions in the core of the product which may damage the inner quality thereof.

Thus, the need is felt to provide a soft reduction device for round-section cast products which allows to overcome the aforesaid drawbacks.

SUMMARY OF THE INVENTION

It is an object of the present invention to provide a soft reduction device for round-section cast metal products, such as blumes or billets, which allows a controlled and effective closing of the liquid cone, thus reducing the section of product with respect to the initial casting one, and at the same time allows maintaining substantially a rounded shape, which already is acceptable for processing and selling the product when it is outlet from said device. Advantageously, the soft reduction device of the invention is designed for carrying out the soft reduction of casting products, made of metal, having a round section, said round section being maintained round sectioned through the whole soft reduction process. Therefore the terminology "round section product" refers both to the casting product, having a liquid or partially liquid core, and to the final product of soft reduction, that is completely solidified.

It is another object of the invention to provide a soft reduction device capable of obtaining completely solidified round section products having a substantially uniform chemical composition along the whole section of the product, and therefore uniform properties.

It is another object of the invention to provide a soft reduction device capable of limiting the formation of voids due to the shrinking from cooling of the product volume.

Thus, the present invention achieves the above objects by providing a soft reduction device of round-section metal products having liquid or partially liquid core for reducing the thickness of said metal product coming from a continuous casting machine, which according to claim 1 comprises at least two soft reduction units, wherein said at least two soft reduction units are arranged in series, wherein each soft reduction unit is provided with a group of only three rolls arranged at 120° from one another, and wherein the group of three rolls of one soft reduction unit is offset by a predetermined angle with respect to the group of three rolls of an adjacent soft reduction unit.

The three rolls of each soft reduction unit interfere with the advancing metal product so as to reduce the section thereof, thus closing the liquid core, by acting at 120° angles from one another so that the resulting vector of the radial pressing forces applied on the product is equal to zero.

By providing pressing forces of equal intensity from three equidistant directions, the closing of the liquid core is more effective since the deformation is less abrupt with respect to the solutions with only two pressing rolls. Indeed, by using only three rolls in each soft reduction unit, the outer surface of the round-section products is wound in an optimal manner. Such a winding causes a good propagation of the pressing forces towards the core of the product since the latter does not have very much space to deform outwards, considering the vicinity between the rolls. Therefore, the material will tend to move mainly towards the center of the product, filling the areas occupied by the liquid core which in turn is forced to retract, or in the case of the mushy zone, to solidify.

This operation results in the forced inner union of the skin, and therefore in the closing of the kissing point obtained through the interpenetration and solidification of the dendrites. Thus, the creation of voids due to the shrinking from cooling of the product volume is also avoided, since the inner space is forcibly filled with solidified material, pushed by the deformation actuated by the soft reduction rolls.

Advantageously, to better keep the rounded shape, several soft reduction units are arranged in series, over which the radial pressing forces are divided, which are therefore applied to a lesser extent by the rolls of the units after the first one.

Advantageously, according to the invention, the number of soft reduction units may vary. In particular, there may be provided from three to eight soft reduction units arranged in series, preferably four soft reduction units arranged in series. It has been noted that providing a number of soft reduction units greater than eight induces a temperature dispersion which does not allow an optimal processing of the material.

To maximize keeping the rounded shape, the arrangement of the rolls advantageously is offset between one soft reduction unit and the next, so that the pressed areas of the product vary from one unit to the other and therefore, the rounded shape is preserved better.

In a first advantageous variant, there are provided two soft reduction units arranged in series, with groups of three offset rolls, i.e. rotated by 180° from one another. This arrangement results in having six rolls, between inlet and outlet of the soft reduction device, which in a front view along the feed direction of the cast round product, are radially arranged with respect to the center of the cast round product, with angles of 60° from one another.

Other variants of the invention may provide further offsetting the groups of rolls of the soft reduction units. For example, there may be provided three soft reduction units with three rolls, therefore with nine rolls in total, arranged so as to obtain, in a front view along the feed direction of the cast round product, an offset of 30° between one roll and the next. Another example instead provides five soft reduction units with three rolls, therefore with fifteen rolls in total, arranged so as to obtain, in a front view along the feed direction of the cast round product, an offset of 15° between one roll and the next, and so on. The more soft reduction units forming the device, the less the contribution of radial pressing force of the rolls required to close the liquid cone since each of them contributes to a partial reduction, thus limiting the excessive deforming effect generated with the solutions of the prior art with only two rolls.

In a further advantageous variant, since it may be complex and costly to provide an increased number of soft reduction units in series while simultaneously offsetting the rolls along many incident axes, there is instead provided the arrangement of a plurality of soft reduction units, preferably four or six or a maximum of eight, arranged in series and with groups of three rolls offset by 180° adjacent from one another. This arrangement results in having twelve or eighteen or twenty-four rolls, between inlet and outlet of the soft reduction device, which in a front view along the feed direction of the cast round product, are radially arranged with respect to the center of the cast round product, with angles of 60° from one another. Thereby, by alternating the axes of the rolls with a sequence of the type Y-λ or λ-Y, it is sufficient to design and construct only two separate types of soft reduction units.

Advantageously, in a preferred variant, in addition to closing the liquid core, the soft reduction units of the device of the invention are also capable of extracting the product from the casting line by performing a function similar to that of the extraction and straightening units which are commonly used in continuous casting machines. In this variant, at least one of the rolls of each soft reduction unit is motorized. This solution allows to avoid the installation, upstream of the soft reduction device, of an extraction unit which should grasp, or grip, intrados and extrados of the product and drag it downstream in the first soft reduction unit and straighten it at the same time.

A further advantage of the present invention is the possibility of providing position adjustment means for adjusting the position of the rolls, so that the same soft reduction unit can process products having various diameters. For example, the rolls may be mutually moved close or away by means of hydraulic actuators, lever or pantograph mechanisms, or others.

Moreover, the movement of the rolls may be performed linearly along guides, sliding blocks or similar elements, or performed by means of curvilinear movements or a combination of linear and curvilinear movements.

The soft reduction rolls may also have various shapes in the stretch in contact with the outer surface of the cast product: they may for example, have a flat panel shape or be shaped and joined with angles adequate to the diameter of the product to be processed.

A further feature of the present solution is the possibility of causing the extrados of the cast product to coincide with the pass-line of the line downstream of the casting curve. Indeed, since the casting line in which the soft reduction units of the present invention will be installed is to cast various diameters of product, there is a need to vary certain geometries of the casting curve, in particular the arrangement of the containment rolls and of the cooling means, by adapting them to those of each cast product. Normally, the assembly of radii on which a casting line is designed is calculated according to the extrados of a product; then the minimum and maximum ranges corresponding to the minimum and maximum intrados of the range of products to be cast, is calculated.

Should the extrados radius vary, there would be problems in aligning the casting line and the utility units downstream (e.g. cooling plates, roller tables, etc.) for each product. Instead, by causing the extrados to coincide with the pass-line, corresponding for example to the cooling plate, such a problem does not exist since the casting curve and cooling plate are always aligned. This advantage results in these soft reduction units also being installable on existing casting lines, since the extension thereof is strictly vertical and they ensure the continuous alignment between cast and utilities downstream.

The dependent claims describe preferred embodiments of the invention.

BRIEF DESCRIPTION OF THE DRAWINGS

Further features and advantages of the invention will be more apparent in light of the detailed description of preferred, but not exclusive, embodiments of a soft reduction device, disclosed by way of a non-limiting example, with the aid of the accompanying drawings in which.

The same reference numerals in the drawings identify the same elements or components.

DETAILED DESCRIPTION OF PREFERRED EMBODIMENTS OF THE INVENTION

With reference to the figures, there is depicted a preferred embodiment of a soft reduction device according to the invention, indicated by 1 as a whole.

Such a soft reduction device is designed to perform a soft reduction of a round-section metal product, having liquid or partially liquid core, i.e. for reducing the thickness of a round-section cast metal product coming from a continuous casting machine. Therefore, each soft reduction unit of the device is substantially different from the guide units with adjustable rolls that guide the cast product simply accompanying the metal product during its advancement without reducing the thickness thereof and, notably, without obtaining a controlled and effective closing of the liquid cone. Moreover, as known to the skilled person, a soft reduction device and a soft reduction unit are well distinguished from a rolling device and a rolling unit, respectively, not only by the functional point of view but also by the constructional point of view. Indeed, the rolling devices or units—unlike the soft reduction devices or units—are designed to reduce the thickness of a completely solidified metal product (thus without liquid core). The rolling devices or units are provided with backup rolls, while the soft reduction devices or units are not. The backup rolls are present in the rolling devices or units to provide a robust support for the working rolls, thus helping to ensure a proper performance of the entire rolling mill. Also, the forces acting on the metal product in a rolling device are different from the forces acting on the metal product in a soft reduction device, given the difference in the consistency between a completely solidified product and a casting product. The several constructional differences between soft reduction devices and rolling devices are also reflected in their cost, the latter costing at least twice as much as the soft reduction devices.

Figure 1:
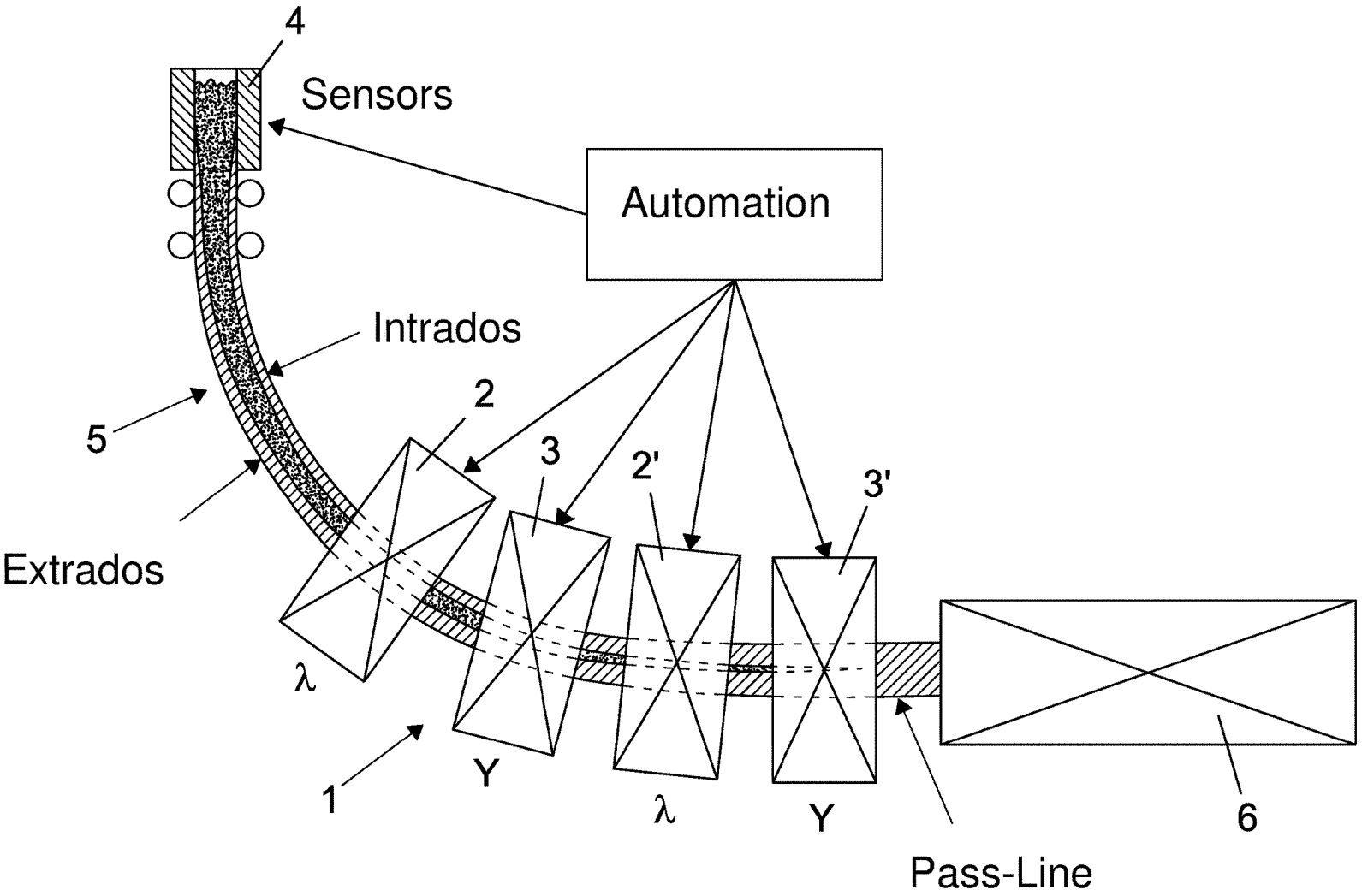
FIG. 1 depicts a diagram of a casting line comprising a soft reduction device according to the invention.

FIG. 1 shows part of a plant for a continuous production of round-section metal products comprising:

- a continuous casting machine provided with at least one round-section crystallizer 4 and a respective casting curve 5;
- a soft reduction device 1 arranged near the end of the respective casting curve 5, and a processing line 6 of the round-section metal product, arranged downstream of the soft reduction device 1.

The soft reduction device 1 comprises at least two soft reduction units 2, 3 arranged in series along the feed direction of the metal product.

Advantageously, each soft reduction unit 2, 3 is provided with a group of only three rolls arranged at 120° from one another, and the group of three rolls of one soft reduction unit is offset by a predetermined angle with respect to the group of three rolls of the next soft reduction unit.

In the variant in FIG. 1, there are provided four soft reduction units 2, 3, 2', 3' and the group of three rolls of a soft reduction unit is offset by 180° with respect to the group of three rolls of the next and adjacent soft reduction unit. Thus, the soft reduction units indicated by numerals 2, 2' have an equal angular arrangement of the three rolls, offset by 180° with respect to the equal angular arrangement of the three rolls of the soft reduction units indicated by numerals 3, 3'.

In the example in FIG. 1, at least the first soft reduction units of the device of the invention are positioned along the end part of the casting curve 5 and act also as extraction and straightening units.

In another example (not shown), all the soft reduction units are arranged parallel to one another along a completely rectilinear stretch of plant, i.e. completely after the casting curve 5. Here, there are provided specific extraction and straightening units upstream of the device of the invention.

In another variant of the invention, there instead are provided only two soft reduction units and the group of three rolls of the first soft reduction unit is offset by 180° with respect to the group of three rolls of the second soft reduction unit, which is subsequent and adjacent to the first soft reduction unit.

Other variants may include, for example, the use of four, six or eight soft reduction units, with the group of three rolls of a soft reduction unit offset by 180° with respect to the group of three rolls of the subsequent and adjacent soft reduction unit.

Figure 10:
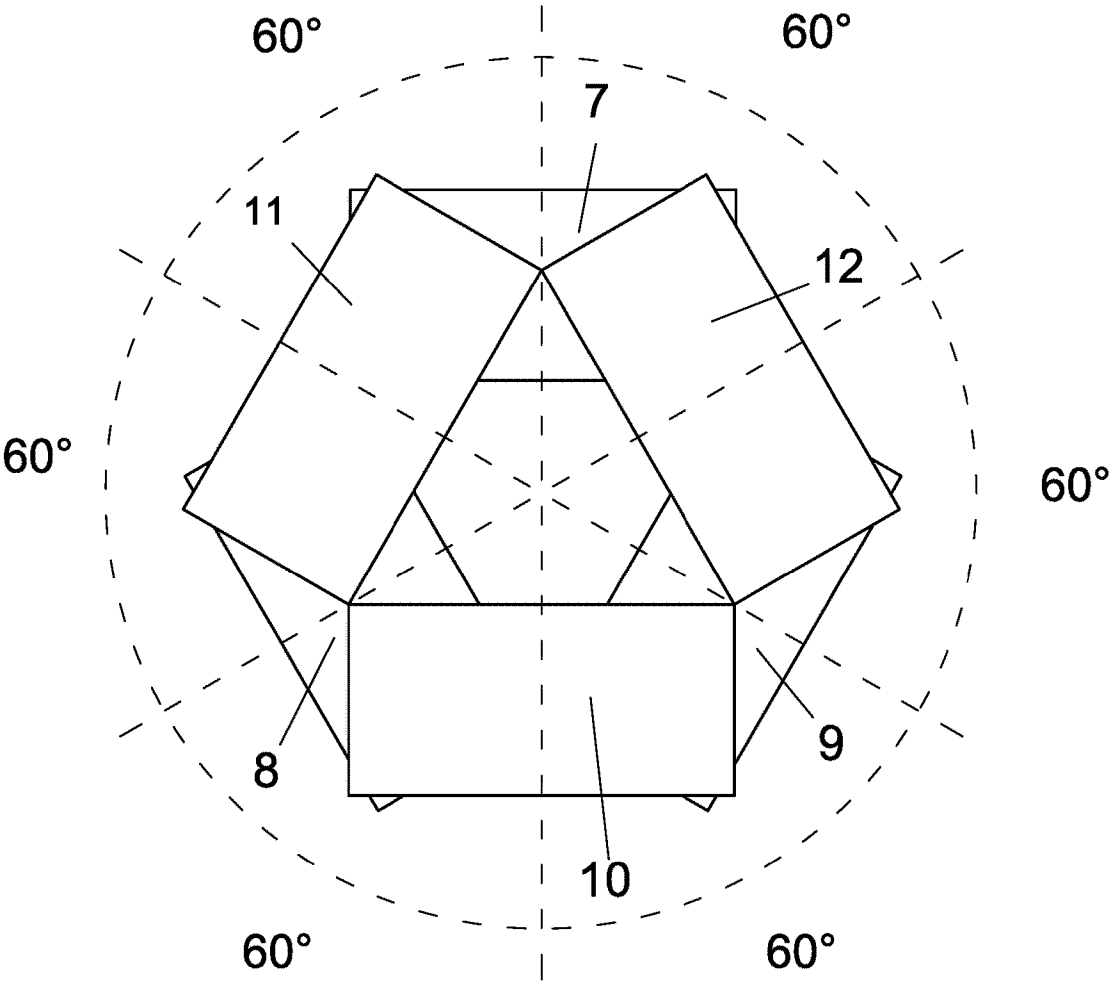
FIG. 10 depicts a diagrammatic front view of the rolls of the soft reduction unit, in a preferred variant.

In all these variants, the angular arrangement between the roll units results in having a plurality of rolls, between inlet and outlet of the soft reduction device, which in a front view along the feed direction of the metal product, are radially arranged with respect to the center of the product itself, for example, with angles of 60° from one another, as shown in FIG. 10.

The more soft reduction units forming the device, the less the contribution of radial pressing force which each soft reduction unit should ensure to close the liquid cone, since each of them contributes to a partial reduction of the thickness of the metal product.

A further advantage of the present invention is the possibility of adjusting the position of the rolls of each soft reduction units to adapt the device to the processing of metal products of various diameters.

Advantageously, each soft reduction unit may be provided with adjustment means for adjusting the position of at least two rolls of the three rolls, which adjustment means are configured to adjust the position of the rolls with respect to the center of the metal product to be pressed, that is with respect to the advancement axis of the metal product to be pressed, while keeping the centerline planes of the three rolls, which are perpendicular to the respective rotation axes of said three rolls, at 120° from one another in any working position. Therefore, the three rolls always apply equal radial pressing forces at 120° from one another, directed towards the center of the metal product, during the passage of the metal product in a zone delimited by the three rolls, and the resultant vector of said radial pressing forces is equal to zero.

In a preferred embodiment shown in FIGS. 2 and 3, the soft reduction units 2 and/or 2' comprise an upper roll 7 having a horizontal rotation axis and arranged above two lower rolls 8, 9 having a rotation axis inclined with respect to the horizontal, while the subsequent and adjacent second soft reduction units 3 and/or 3' comprise a lower roll 10 having a horizontal rotation axis and arranged fixedly below two upper rolls 11, 12 having a rotation axis inclined with respect to the horizontal, or vice versa. The configuration of the rolls of the soft reduction unit in FIG. 3 can be defined as a Y shaped configuration and the configuration of the rolls of the soft reduction unit in FIG. 2 can be defined as an upside-down Y configuration or as λ (lambda) configuration, considering the arrangement of the centerline planes of the rolls, which are orthogonal to the respective rotation axes. To improve the extraction and straightening function, it is preferable to provide, along the feed direction of the product, a soft reduction unit having λ (lambda) configuration (like that shown in FIG. 2) as first soft reduction unit.

However, there it is not necessary for the roll 7 of the soft reduction units 2 and/or 2' and for the roll 10 of the soft reduction units 3 and/or 3' to have a horizontal rotation axis. Such rolls 7, 10 could indeed have a rotation axis which is inclined by an angle other than zero with respect to the horizontal.

Preferably, at least one roll of said three rolls is motorized in each soft reduction unit. In a preferred variant, only roll 7, 10 having a horizontal rotation axis is motorized. For example, in FIG. 2, the upper roll 7 is connected to a shaft 13, optionally to an extension, which may be actuated by motor 14, while the lower roll 10 in FIG. 3 is connected to a shaft 15, optionally to an extension, which may be actuated by motor 16.

In other variants, only two rolls or all three rolls are motorized. This motorization of at least one roll allows to avoid the use of extraction units upstream of the soft reduction device for extracting the product from the casting curve.

Figure 2:
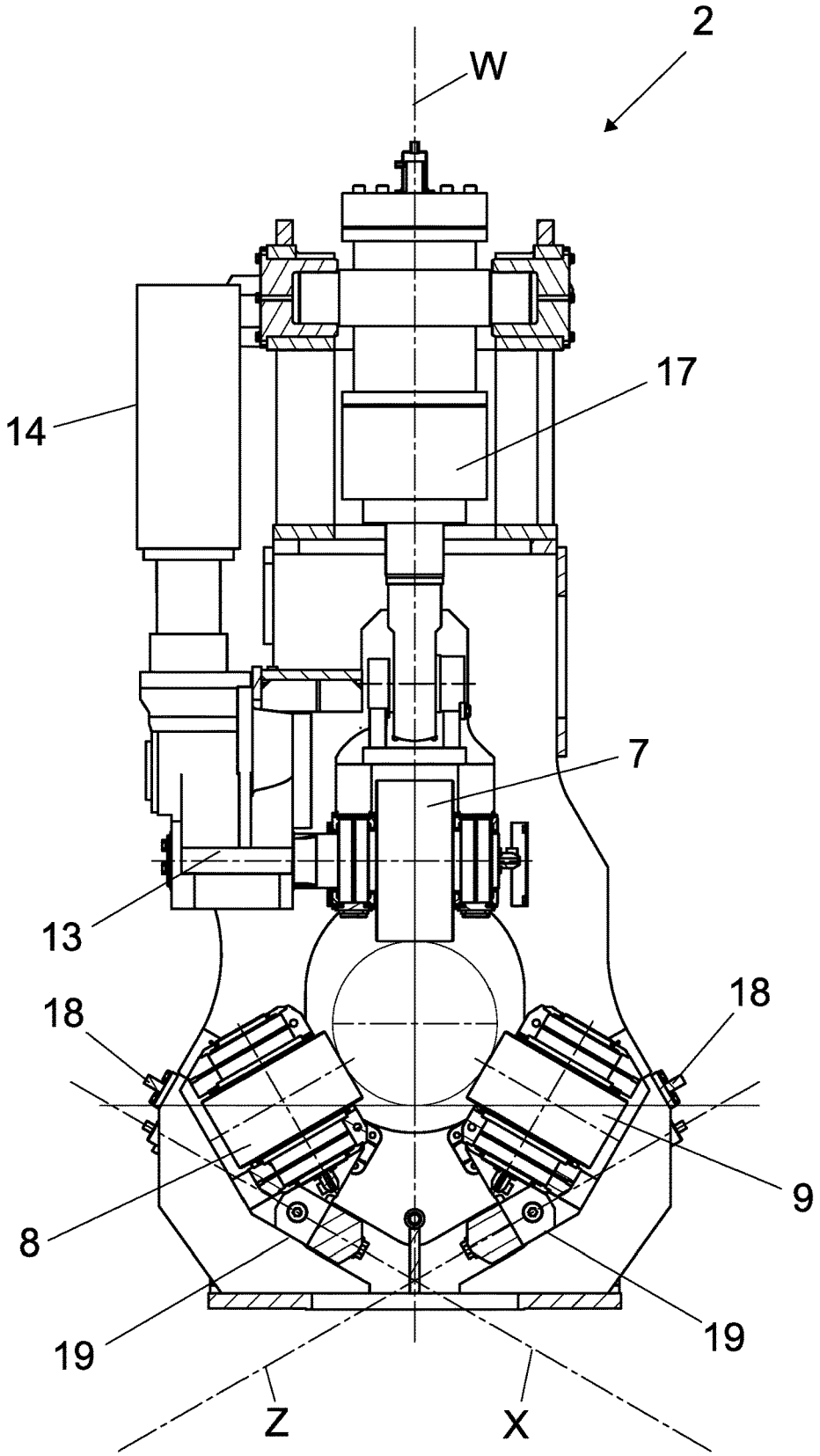
FIG. 2 depicts a side view of a first embodiment of a soft reduction unit of the device of the invention.
Figure 3:
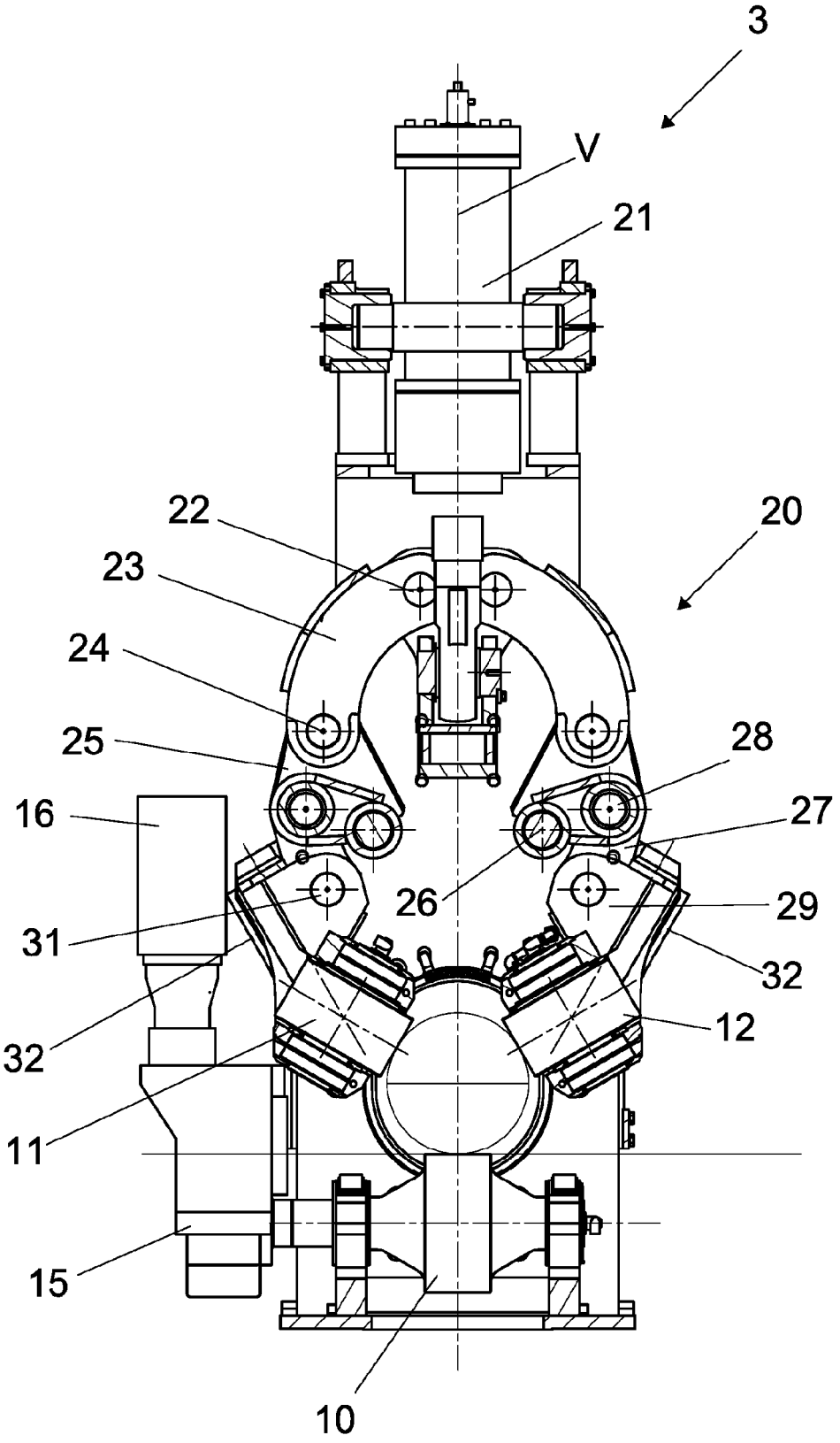
FIG. 3 depicts a side view of a second embodiment of a soft reduction unit of the device of the invention.
Figure 6:
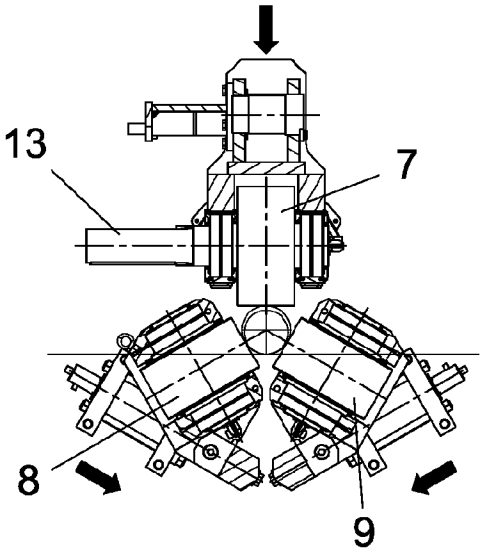
FIG. 6 depicts a side view of the part of FIG. 4, in a third operating position.
Figure 5:
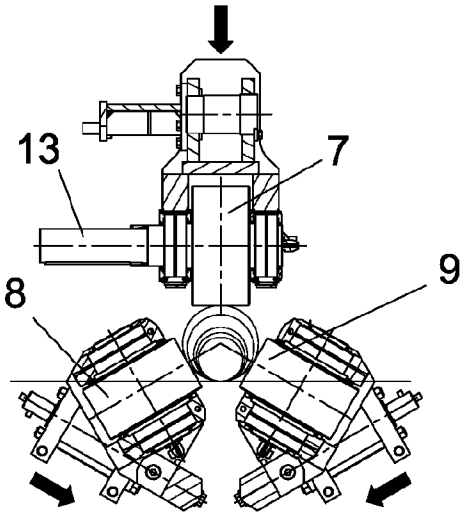
FIG. 5 depicts a side view of the part of FIG. 4, in a second operating position.
Figure 4:
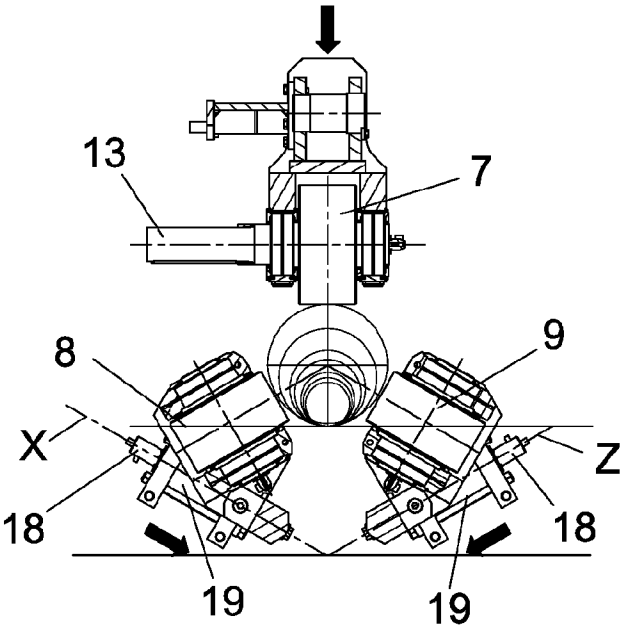
FIG. 4 depicts a side view of part of FIG. 2, in a first operating position.

In the soft reduction unit 2 shown in FIG. 2, the position adjustment means are adapted to adjust the position of all three rolls 7, 8, 9; while in the soft reduction unit 3 shown in FIG. 3, the position adjustment means are adapted to adjust only the position of the two upper rolls 11, 12.

The adjustment means in the soft reduction unit 2 comprise:

first translation means, adapted to translate the upper roll 7 along a centerline plane thereof which is orthogonal to the rotation axis thereof, for example adapted to translate vertically in the case of horizontal rotation axis of roll 7 and soft reduction unit 2 arranged with the longitudinal axis W thereof vertical, and second translation means adapted to translate the two lower rolls 8, 9, arranged at 120° from each other and with respect to the upper roll 7, along respective inclined planes X, Z. The two inclined planes X, Z are convergent and symmetrical with respect to the centerline plane of the upper roll 7. In a preferred variant, the inclined planes X, Z form an angle of 30° with respect to the horizontal.

The lower rolls 8, 9 have centerline planes, which are orthogonal to the respective rotation axes, inclined by an angle other than zero with respect to the planes X, Z and arranged at 120° from the centerline plane of the upper roll 7, thus coinciding with a vertical plane in the case the upper roll has a horizontal rotation axis.

Said first translation means comprise for example, a first cylinder 17 having vertical axis when the roll 7 has horizontal rotation axis and the soft reduction unit 2 is arranged with the longitudinal axis W thereof vertical, and said second translation means comprise at least one second cylinder 18 for each lower roll 8, 9, adapted to linearly move the respective lower roll along a respective fixed guide 19, or fixed sliding block, which fixed guide is inclined according to the respective plane X, Z. In one variant, there are provided for example, two cylinders 18 for each lower roll 8, 9.

FIGS. from 4 to 6 show three positions taken on by the three rolls 7, 8, 9 to adapt to the diameter of the metal product on which the soft reduction is to be performed.

There may be provided sensors for detecting the angular position of the rolls 7, 8, 9 from one another, and/or synchronization means for synchronizing the actuation of the first cylinder 17 and of the second cylinders 18.

In a preferred variant, the adjustment means in the soft reduction unit 3 (FIG. 3) comprise:

- a symmetrical lever mechanism 20 connected in a mirror-like manner to the two upper rolls 11, 12, the levers being symmetrical with respect to a centerline plane V of the lower roll 10 orthogonal to the rotation axis of the lower roll 10 itself,
- and an actuating means of said symmetrical lever mechanism 20.

The centerline plane V is a vertical plane when roll 10 has horizontal rotation axis.

For example, said actuating means is a cylinder 21, for example a hydraulic cylinder, having vertical axis when roll 10 has horizontal rotation axis and the soft reduction unit 3 is arranged with the longitudinal axis thereof vertical.

FIGS. from 7 to 9 show three positions taken on by the upper rolls 11, 12 to adapt to the diameter of the metal product on which the soft reduction is to be performed, the lower roll 10 being in fixed position.

The symmetrical lever mechanism 20 may comprise, for example:

- a movable element or pressure element 30, which slides along plane V, on which cylinder 21 acts;
- two first levers 23, which are symmetrical with respect to plane V, hinged at a first end of the pressure element 30 by means of a respective pin 22;
- two joints 25, which are symmetrical with respect to plane V, for example in the shape of a substantially triangular plate, having a first vertex hinged to a second end of a respective first lever 23 by means of a respective pin 24, and a second vertex hinged by means of a respective fixed pin 26 to the structure of the soft reduction unit;
- two second levers 27, which are symmetrical with respect to plane V, hinged at a first end thereof by means of a respective pin 28 to the third vertex of the respective joint 25, and hinged at a second end thereof by means of a respective pin 31 to a respective roll-holder device 29.

Each joint 25 therefore connects a first lever 23 to the respective second lever 27.

Each roll-holder device 29 supports one of the two upper rolls 11, 12 of the soft reduction unit 3, which are arranged at 120° from one another and with respect to the lower roll 10, and is configured to slide along a respective inclined plane X', Z'. The two inclined planes X', Z' are convergent and symmetrical with respect to plane V.

When the roll-holder device 29 slides, it linearly moves the respective upper roll 11, 12 along a related fixed guide, or fixed sliding block, which is inclined according to the respective plane X', Z'.

In a preferred variant, the planes X', Z' form an angle of 30° with respect to plane V. The upper rolls 11, 12 have centerline planes, which are orthogonal to the respective rotation axes, inclined by an angle other than zero with respect to the planes X', Z' and arranged at 120° from the centerline plane of the fixed lower roll 10, coinciding with the vertical plane V in the case roll 10 has a horizontal rotation axis.

With reference to FIGS. 3 and 7 to 9, below is described the sequence of movements of the aforesaid mechanism 20.

Cylinder 21, which controls the movement and adjusts the pressing of the upper rolls 11, 12, presses on the pressure element 30 which slides downwards along plane V.

Figure 8:
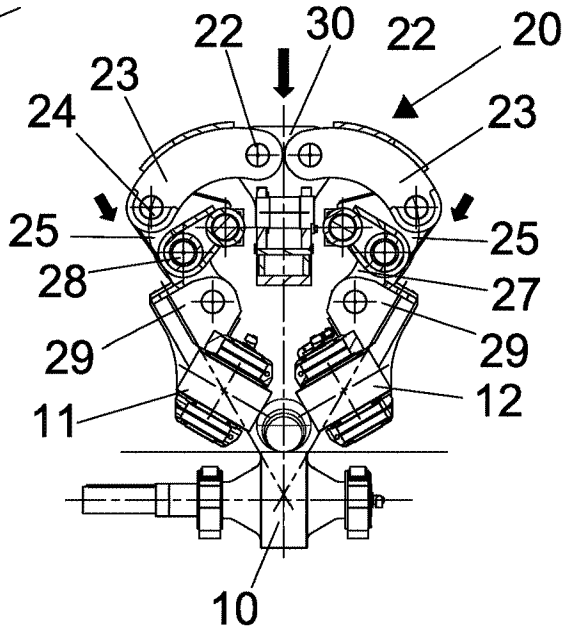
FIG. 8 depicts a side view of the part of FIG. 7, in a second operating position.
Figure 7:
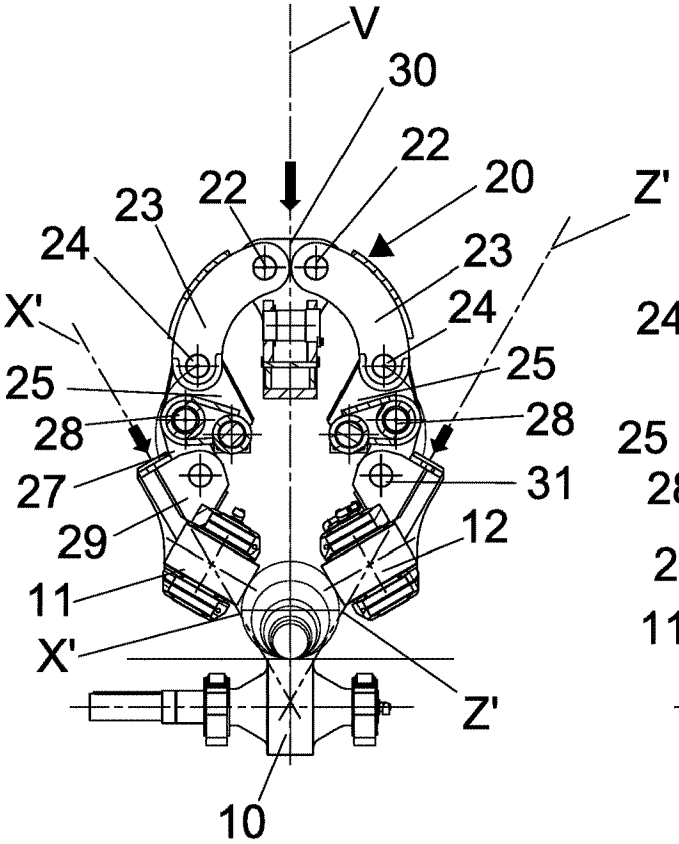
FIG. 7 depicts a side view of part of FIG. 3, in a first operating position.

As shown in the passage from FIG. 7 to FIG. 8, the pins 22, which are integral with the pressure element 30, slide downwards, thus lowering the first levers 23 which second ends simultaneously widen outwards (see position of the pins 24 in FIG. 8).

This movement of the first levers 23 causes a rotation of the joints 25 about the fixed pins 26, which causes a downwards push of the pins 28, and therefore of the second levers 27. In the configuration in FIG. 8, the pins 28 are aligned with the respective pins 24 of the first levers 23 and with the pins 31 of the respective roll-holder devices 29.

The downwards movement of the pins 28 causes a downwards movement of the roll-holder devices 29. In particular, the alignment of the pins 28 with the pins 24 and the pins 31 allows a transmission of a linear force which causes the roll-holder devices 29 to slide on the respective sliding blocks or fixed guides, thus linearly moving downwards the rolls 11, 12 along the inclined planes X', Z'.

Figure 9:
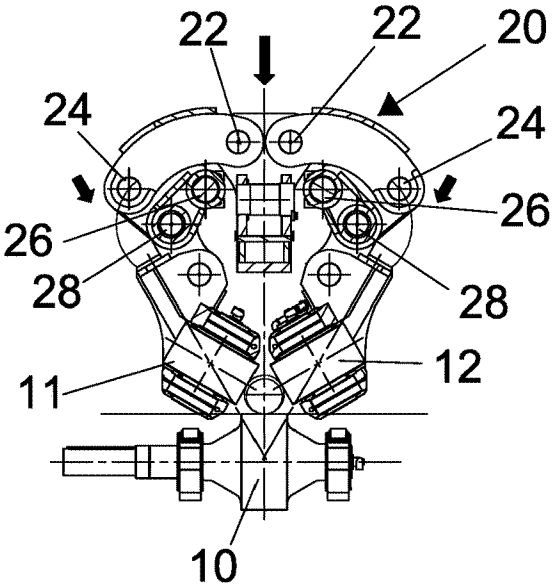
FIG. 9 depicts a side view of the part of FIG. 7, in a third operating position.

As shown in the passage from FIG. 8 to FIG. 9, the maximum pressure of cylinder 21 results in a further rotation of the joints 25 about the fixed pins 26 and the simultaneous maximum lowering of the roll-holder devices 29, with associated rolls 11, 12, along the sliding blocks or fixed guides 32 (FIG. 3).

There may be provided sensors for detecting the angular position of the rolls 10, 11, 12 between one another.

In an alternative variant (not shown), the adjustment means in the soft reduction unit 3 (FIG. 3) may instead comprise two actuating means, for example two cylinders, arranged symmetrically with respect to plane V and adapted to cause the roll-holder devices 29 to slide on the respective sliding blocks or fixed guides, thus linearly moving downwards the upper rolls 11, 12 along the inclined planes X'. Z'. In this variant, there may be provided sensors for detecting the angular position of the rolls 10, 11, 12 between one another, and/or synchronization means for synchronizing the actuation of the two actuating means.

A further advantage of the present invention lies in the fact that the above-described adjustment means of the position of the rolls may be used to cause the extrados of the cast metal product to coincide with the pass-line of the processing line downstream of the casting curve.

Advantageously, the lower rolls 8, 9 and 10 of the at least two soft reduction units 2, 3 are positioned so that the extrados of the casting curve 5 upstream coincides with the pass-line of the processing line 6 downstream (FIG. 1).

In particular, the fixed lower roll 10 of the soft reduction units 3, 3', i.e. those with configuration of the soft reduction rolls having Y shape, is arranged so as to cause the resting surface thereof for the advancing metal product to coincide with the pass-line of the processing line 6; while the position of the two lower rolls 8, 9 of the soft reduction units 2, 2', i.e. those with configuration of the soft reduction rolls having upside-down Y or/shape, may be adjusted, by means of the aforesaid adjustment means, so that the extrados of the advancing metal product coincides with the pass-line of the processing line 6.

The adjustment of the position of the lower rolls 8, 9 may be performed for example, due to the automation of the plant, which through measuring devices installed along the casting line and on the soft reduction device itself, may measure the cast section and calculate the correct height at which to set said lower rolls, so as to cause the pass-line to coincide with the extrados of the product, thus achieving the reduction treatment adequate for the thermal model set for the type of product processed. The pressing pressures of the various units forming the soft reduction device may also be set through automation, thus achieving the so-called dynamic soft reduction. Thereby, the liquid core of the product will certainly be pressed in an optimal manner, while simultaneously keeping it in a final shape as close as possible to the round shape.

Therefore, a continuous production process of round-section metal products according to the invention comprises:

- continuously casting a round-section metal product by means of a continuous casting machine provided with at least one round-section crystallizer 4 and a respective casting curve 5;
- carrying out a soft reduction of said round-section metal product, while keeping the round section through the whole soft reduction operation by means of the soft reduction device 1 arranged near the end of the respective casting curve 5;
- processing the round-section metal product exiting from said soft reduction device 1 by means of the processing line 6.

Advantageously, during the soft reduction, there may be provided an adjustment of the position of at least two rolls of the three rolls of the soft reduction unit with respect to the center of the metal product to be pressed so as to keep the centerline planes of the three rolls, which are perpendicular to the respective rotation axes of said three rolls, at 120° from one another in any working position, adapting the soft reduction units to the diameter of the metal product which passes in the area delimited by the respective three rolls. Thereby, said three rolls apply equal radial pressing forces at 120° from one another, directed towards the center of the metal product, and the resultant vector of said radial pressing forces is equal to zero.

The invention claimed is:

1. A soft reduction device of a casting product made of metal with a round-section having liquid or partially liquid core, for reducing a thickness of said casting product, coming, from a continuous casting machine, while maintaining the round section, the device comprising at least two soft reduction units, wherein said at least two soft reduction units are arranged in series, wherein each soft reduction unit is provided with a group of only three rolls arranged at 120° from one another, and wherein the group of three rolls of one soft reduction unit is offset by a predetermined angle with respect to the group of three rolls of an adjacent soft reduction unit.

2. The device according to claim 1, wherein said predetermined angle is 180°.

3. The device according to claim 1, wherein there are provided only two soft reduction units and the group of three rolls of a first soft reduction unit is offset by 180° with respect to the group of three rolls of a second soft reduction unit, which is subsequent and adjacent to the first soft reduction unit.

4. The device according to claim 1, wherein there are provided from three to eight soft reduction units.

5. The device according to claim 1, wherein there are provided four soft reduction units and the group of three rolls of a soft reduction unit is offset by 180° with respect to the group of three rolls of the subsequent and adjacent soft reduction unit.

6. The device according to claim 1, wherein each soft reduction unit is provided with position adjustment means for adjusting the position of at least two rolls of said three rolls, adapted to adjust a position of the rolls with respect to a center of the metal product to be pressed keeping centerline planes of the three rolls, which are perpendicular to respective rotation axes of said three rolls, at 120° from one another in any working position.

7. The device according to claim 6, wherein a first soft reduction unit comprises an upper roll having a respective rotation axis and arranged above two lower rolls having a rotation axis inclined by a 60° angle with respect to the rotation axis of the upper roll, while the subsequent and adjacent second soft reduction unit comprises a lower roll having a respective rotation axis, and arranged fixedly below two upper rolls having a rotation axis inclined by a 60° angle with respect to the rotation axis of the lower roll, or vice versa.

8. The device according to claim 7, wherein in said first soft reduction unit the position adjustment means are adapted to adjust the position of all three rolls, while in said second soft reduction unit the position adjustment means are adapted to adjust only the position of the two upper rolls.

9. The device according to claim 8, wherein the position adjustment means of said first soft reduction unit comprise first translation means, adapted to translate the upper roll along a centerline plane thereof which is perpendicular to the respective rotation axis, and second translation means adapted to translate the two lower rolls along respective inclined planes X, Z, the two inclined planes X, Z being convergent and symmetrical with respect to the centerline plane of the upper roll.

10. The device according to claim 9, wherein said first translation means comprise a first cylinder, and said second translation means comprise at least one second cylinder for each lower roll, adapted to linearly move the respective lower roll along a fixed guide.

11. The device according to claim 8, wherein the position adjustment means of said second soft reduction unit comprise

- a symmetrical lever mechanism symmetrically connected to the two upper rolls, the levers being symmetrical with respect to a centerline plane of the lower roll orthogonal to the rotation axis of said lower roll,
- and an actuating means of said symmetrical lever mechanism,
- said symmetrical lever mechanism being configured to translate the two upper rolls along respective inclined planes X', Z', the two inclined planes X', Z' being convergent and symmetrical with respect to said centerline plane of the lower roll.

12. The device according to claim 11, wherein said actuating means is a cylinder.

13. The device according to claim 8, wherein the position adjustment means in said second soft reduction unit comprise two actuating means, arranged symmetrically with respect to a center plane of the lower roll orthogonal to the rotation axis of said lower roll, said actuating means being adapted to move the upper rolls linearly along respective inclined planes X', Z', the two inclined planes X', Z' being convergent and symmetrical with respect to said center plane of the lower roll.

14. The device according to claim 1, wherein at least one roll of said three rolls is motorized in each soft reduction unit.

15. The device according to claim 1, wherein a first soft reduction unit comprises an upper roll having a respective rotation axis and arranged above two lower rolls having a rotation axis inclined by a 60° angle with respect to the rotation axis of the upper roll, while a subsequent and adjacent second soft reduction unit comprises a lower roll having a respective rotation axis and arranged fixedly below two upper rolls having a rotation axis inclined by a 60° angle with respect to the rotation axis of the lower roll, or vice versa.

16. A plant for a continuous production of round-section metal products comprising a continuous casting machine provided with at least one round-section crystallizer and a respective casting curve;

a soft reduction device according to claim 1 arranged near an end of the respective casting curve, a processing line of the round-section metal product exiting from said soft reduction device, wherein lower rolls of the at least two soft reduction units are positioned so that an extradoss of the casting curve coincides with a pass-line of said processing line.

17. A continuous production process of round-section metal products, by means of a plant according to claim 16, comprising the following steps:

continuously casting a round-section metal product, by means of a continuous casting machine provided with at least one round-section crystallizer and a respective casting curve;

carrying out a soft reduction of said round-section metal product, while keeping the round section through the whole soft reduction operation by means of the soft reduction device arranged near the end of the respective casting curve;

processing the round-section metal product exiting from said soft reduction device by means of the processing line.

* * * * *